US005895072A

United States Patent [19]

Coroneos et al.

[11] Patent Number: 5,895,072

[45] Date of Patent: Apr. 20, 1999

[54] DEVICE FOR SECURING CHALK TO AN IN-LINE SKATE

[75] Inventors: Frank William Coroneos, Chanhassen; Dirk L. Cornelius, Oakdale; Sherry S. Eckholm, Minneapolis, all of Minn.

[73] Assignee: Rollerblade, Inc., Eden Prairie, Minn.

[21] Appl. No.: 09/001,589

[22] Filed: Dec. 31, 1997

[51] Int. Cl.[6] ..... B60Q 1/26

[52] U.S. Cl. ..... 280/811; 280/809

[58] Field of Search ..... 280/809, 811; 434/417; 33/27.03

[56] References Cited

U.S. PATENT DOCUMENTS 5,171,033 12/1992 Olson et al. .

5,253,883 10/1993 Moldenhauer .

5,380,020 1/1995 Arney et al. .

*Primary Examiner*—Robert J. Oberleitner

*Assistant Examiner*—Clovia Hamilton

*Attorney, Agent, or Firm*—Merchant, Gould, Smith, Edell, Welter & Schmidt, P.A.

[57] ABSTRACT

The present disclosure relates to a device for securing a piece of chalk to a skate. The device includes a chalk holder defining a chalk opening sized for receiving a piece of chalk. The device also includes an arrangement for connecting the chalk holder to the skate such that the chalk is adapted to contact a ground surface when the skate is used by a skater.

30 Claims, 4 Drawing Sheets

DEVICE FOR SECURING CHALK TO AN IN-LINE SKATE

FIELD OF THE INVENTION

The present invention relates generally to roller skates and roller skate accessories. More particularly, the present invention relates to in-line roller skates and in-line roller skate accessories.

BACKGROUND OF THE INVENTION

A typical in-line roller skate includes a molded plastic boot having a rigid frame secured to the sole of the boot. Four tandemly arranged wheels are commonly rotatably secured to the frame. The wheels are generally made of a material such as urethane and are provided in a wide range of different sizes and hardnesses each suited for different performance requirements. For example, larger wheels allow for higher top-end speeds and smoother rides on rougher surfaces, while smaller wheels provide faster acceleration and greater maneuverability. Also, harder wheels provide fast speeds on smooth, outdoor surfaces and increased wear life, while softer wheels provide increased traction and smooth rides on bumpy surfaces. Conventional in-line skates are additionally typically equipped with rear brake arrangements including brake pads configured for frictionally engaging the ground surface to provide a braking action.

The development of in-line skates has helped to increase the popularity of roller skating. Specifically, contemporary in-line skates are designed to provide a relatively smooth and fast ride on exterior surfaces such as asphalt and concrete pavement. Consequently, in-line skates have helped to move roller skating from a primarily indoor activity to more of an outdoor activity. Many participants are children that use in-line skating as a source of outdoor recreational activity.

SUMMARY OF THE INVENTION

One aspect of the present invention relates to a device for securing a piece of chalk to a skate. The device includes a chalk holder defining a chalk opening sized for receiving a piece of chalk. The device also includes means for connecting the chalk holder to the skate such that the chalk is adapted to contact a ground surface when the skate is used by a skater.

Another aspect of the present invention relates to a skate including a frame arrangement, and a plurality of wheels rotatably connected to the frame arrangement. The skate also includes a chalk holding device connected to the frame arrangement. The chalk holding device includes a chalk holder arranged and configured for holding a piece of chalk such that the chalk is adapted to contact a ground surface when the skate is used by a skater.

The various aspects of the present invention provide devices and skates for allowing a skater to draw chalk designs and messages on a pavement surface as the skater skates.

A variety of advantages of the invention will be set forth in part in the description which follows, and in part will be apparent from the description, or may be learned by practicing the invention. It is to be understood that neither the foregoing general description nor the following detailed description are restrictive of the invention as claimed.

BRIEF DESCRIPTION OF THE DRAWINGS

The accompanying drawings, which are incorporated in and constitute a part of the specification, illustrate several aspects of the invention and together with the description, serve to explain the principles of the invention. A brief description of the drawings is as follows.

DETAILED DESCRIPTION

Reference will now be made in detail to various aspects of the present invention which are illustrated in the accompanying drawings. Wherever possible, the same reference numbers will be used throughout the drawings to refer to the same or like parts.

Figure 1:
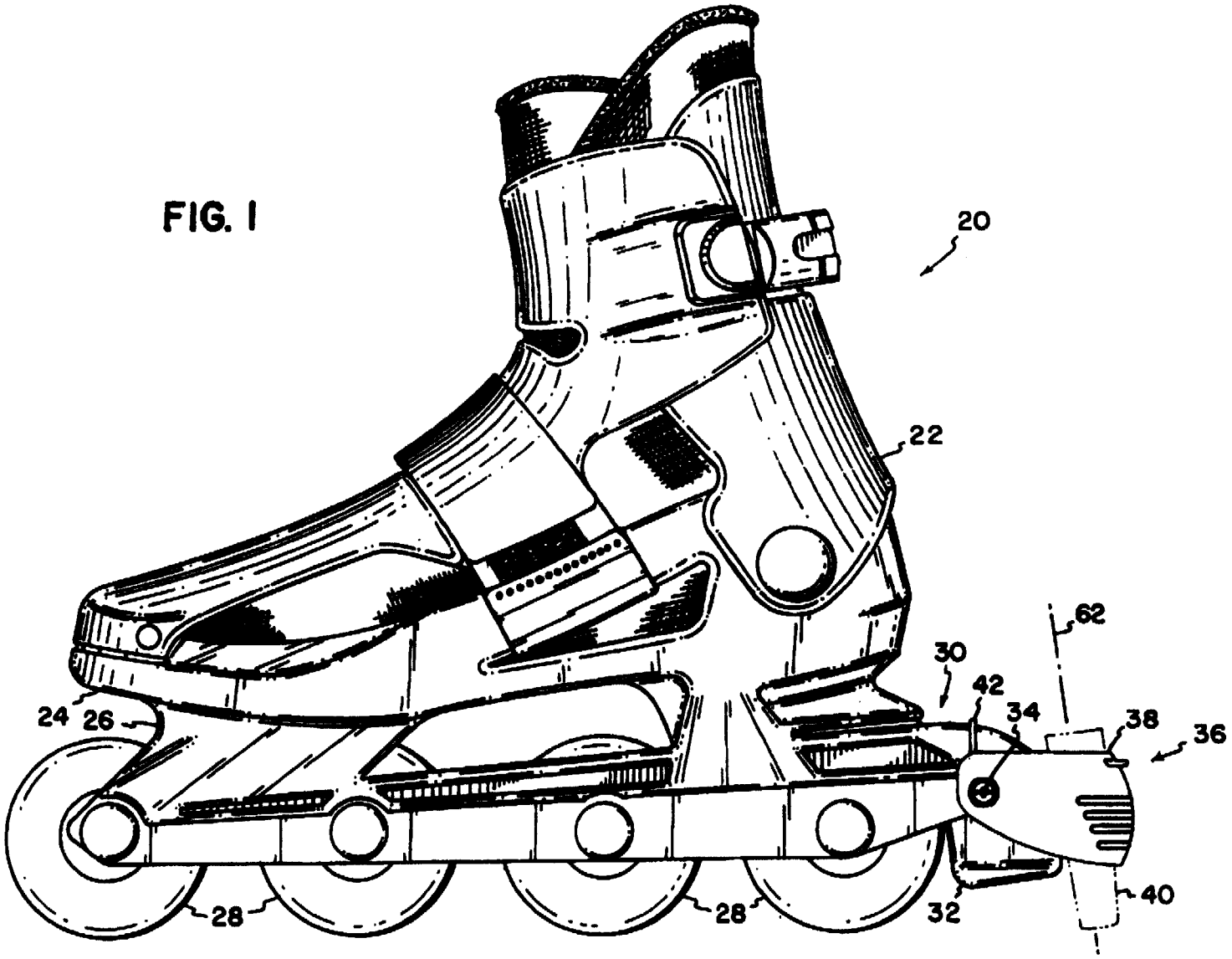
FIG. 1 is a perspective view of an in-line skate constructed in accordance with the principles of the present invention, the skate includes a chalk holding device pivotally connected behind a brake arrangement of the skate.
Figure 2:
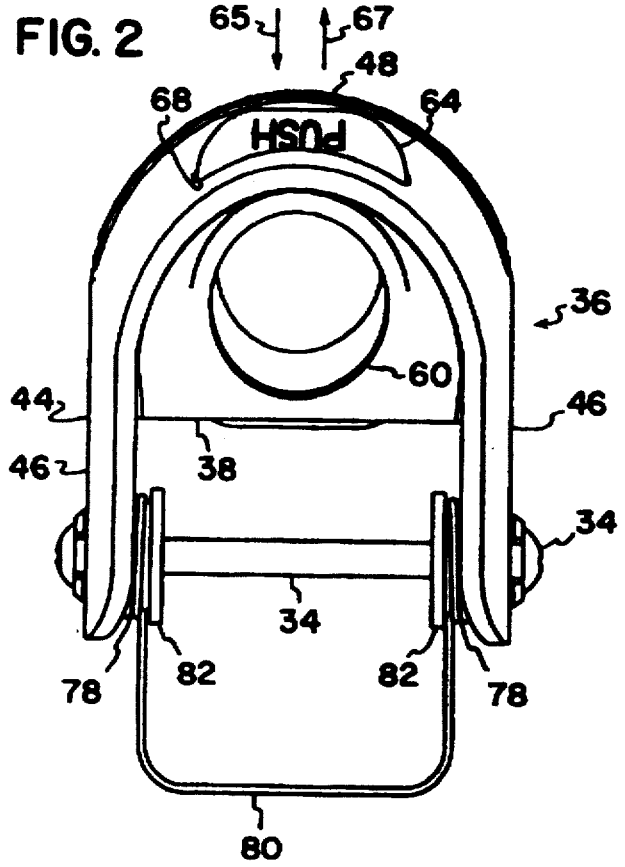
FIG. 2 is a top view of the chalk holding device shown in FIG. 1.
Figure 3:
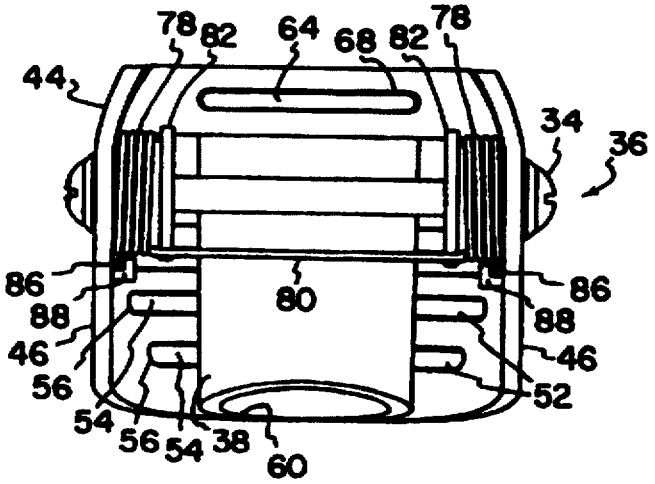
FIG. 3 is a front view of the chalk holding device shown in FIG. 1.
Figure 4:
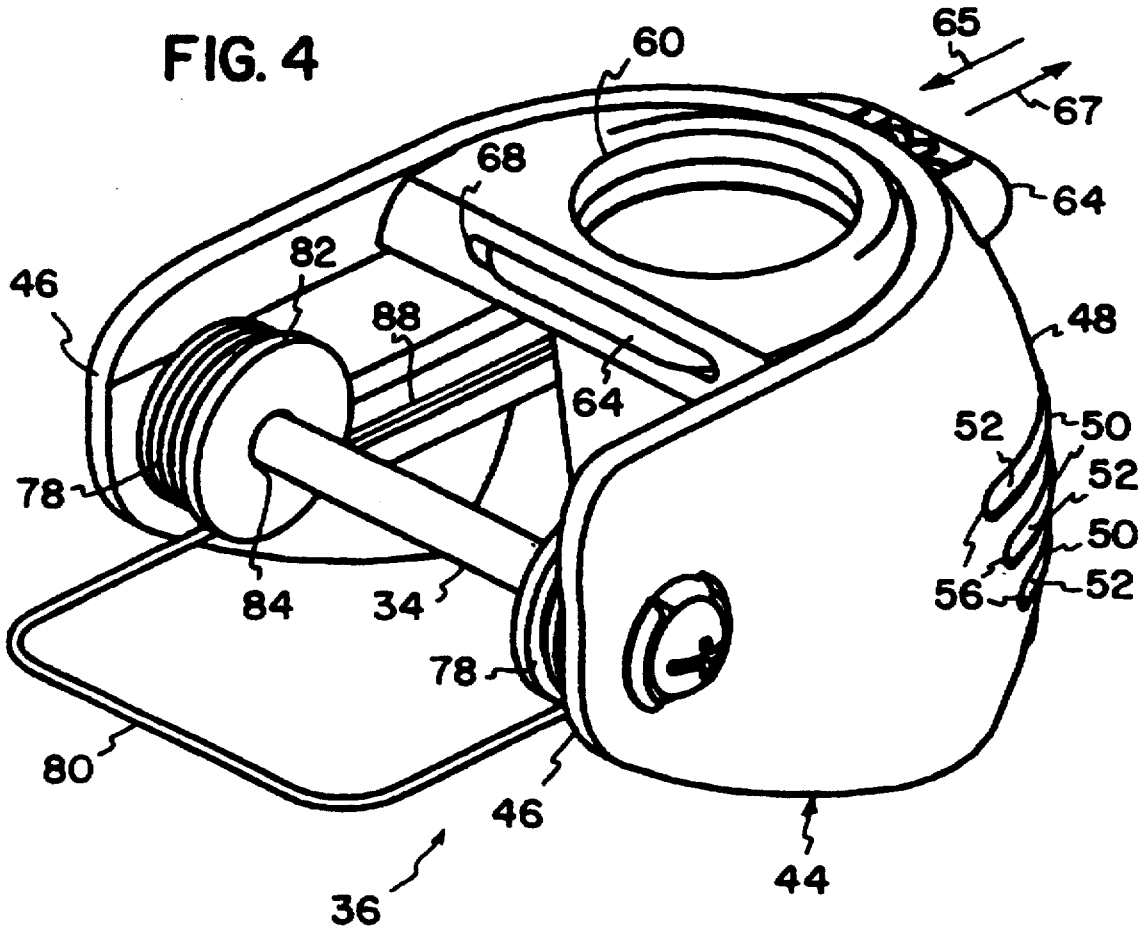
FIG. 4 is a front perspective view of the chalk holding device shown in FIG. 1.

FIG. 1 shows a side view of an exemplary in-line skate 20 constructed in accordance with the principles of the present invention. The illustrated skate 20 is a left skate which is used in combination with a right skate constructed in the mirror image of the left skate 20. Generally, the skate includes a boot 22 having a sole 24 to which a frame 26 is connected. A plurality of tandemly arranged wheels 28 are rotatably connected to the frame 26. The skate 20 also includes a brake arrangement 30 located at a rear portion of the frame 26. The brake arrangement 30 includes a brake pad 32 secured to the frame 26 by a pivot member, pin, bolt or axle 34 that extends transversely across the frame 26 and extends through holes (not shown ) defined by the frame 26.

The skate 20 also includes a chalk holding device 36 pivotally mounted behind the brake arrangement 30. Although the present invention is not limited to such a configuration, the chalk holding device 36 is shown pivotally mounted on the transverse axle 34. The chalk holding device 36 includes a chalk holder 38 arranged and configured for holding a piece of chalk 40 such that the chalk is adapted to contact a ground surface when the skate 20 is used by a skater. The chalk holding device 36 also includes a spring structure 42 arranged and configured for biasing the chalk holder 38 toward the ground surface such that the chalk 40 remains in contact with the ground surface to enable the skater to draw chalk designs and messages on the ground surface. Further details concerning the chalk holding device 36 are provided in FIGS. 2–6 and in the following paragraphs.

Referring to FIGS. 2–6, the chalk holding device 36 is shown as including a connecting portion or outer housing 44 in which the chalk holder 38 is secured. The housing 44 is generally U-shaped and includes two opposing spaced-apart leg portions 46 projecting forwardly from a curved rear portion 48. The curved rear portion 48 defines a plurality of substantially parallel slots 50 arranged and configured to receive corresponding substantially parallel fins or ribs 52 that project rearwardly from the chalk holder 38. Forward portions 54 of the ribs 52 engage ends 56 of the slots 50 to retain the chalk holder 38 within the housing 44. It will be appreciated that the above described configuration is but one embodiment of the present invention and that other configurations can also be used.

The chalk holder 38 of the chalk holding device 36 preferably defines a chalk opening 60 sized for receiving the piece of chalk 40. In certain embodiments, the chalk opening 60 has a diameter that tapers inward in a downward direction such that the diameter of the chalk opening 60 is larger at the top of the opening 60 as compared to the bottom of the opening 60. In such embodiments, the chalk opening 60 is most likely suited for use with a corresponding generally frustral conical shaped piece of chalk. Of course, the present invention can be used with pieces of chalk having any type of shape. Additionally, the terms "piece of chalk" or "chalk" are intended to include various writing/drawing/marking implements such as spray chalk dispensers, crayon type writing implements, and any other type of marking article or device.

Referring back to FIG. 1, when the chalk holding device 36 is mounted on the skate 20, the chalk opening 60 is preferably aligned along a longitudinal axis 62 that forms an acute angle with respect to vertical. For example, the chalk opening 60 is preferably aligned such that the writing end of the chalk 40 trails a top end of the chalk 40. Of course, the present invention is not limited to such a configuration and includes chalk holders having vertical chalk openings as well as configurations in which the writing end of a piece of chalk leads the top end of the chalk.

The chalk holding device 36 preferably also includes a means for retaining the piece of chalk 40 in the chalk opening 60 such as a spring clip 64. The spring clip 64 is transversely mounted relative to the chalk opening 60 and defines a clip opening 66 sized for receiving the piece of chalk 40. The clip 64 is mounted within a transverse slot 68 having portions defined by the chalk holder 38 and the housing 44, and is moveable within the transverse slot 68 between a non-retaining position and a retaining position. In the non-retaining position, the clip opening 66 co-axially aligns with the chalk opening 60 such that the chalk opening 60 is unobstructed. In the retaining position, a retaining portion 70 of the spring clip 64 projects into the chalk opening 60 thereby partially obstructing the chalk opening 60.

Figure 6:
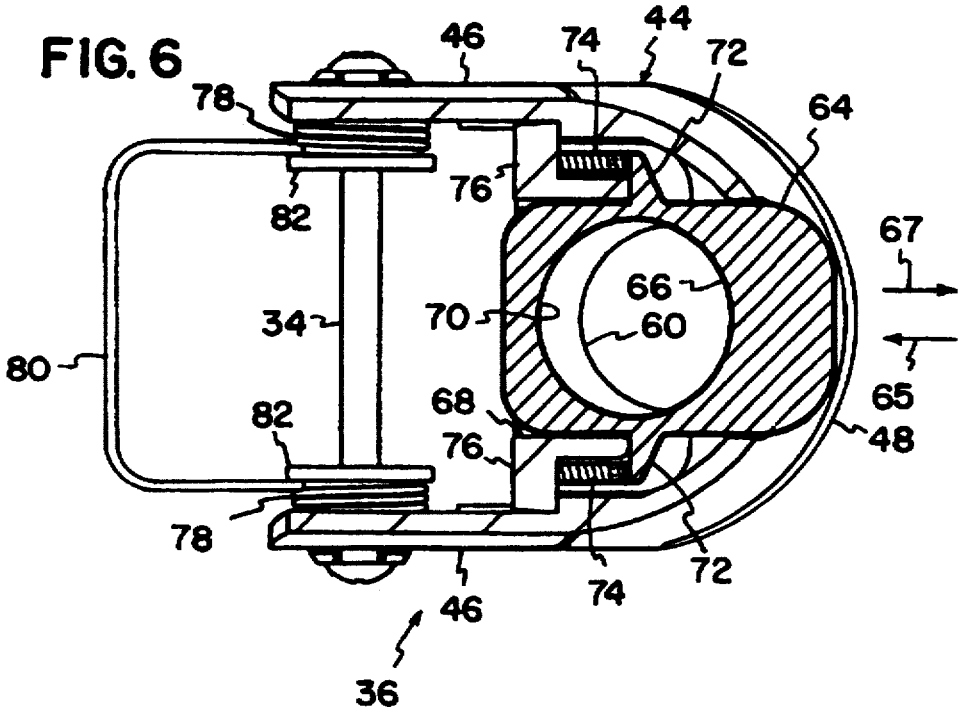
FIG. 6 is a cross-sectional view taken along section line 6—6 of FIG. 5.
Figure 5:
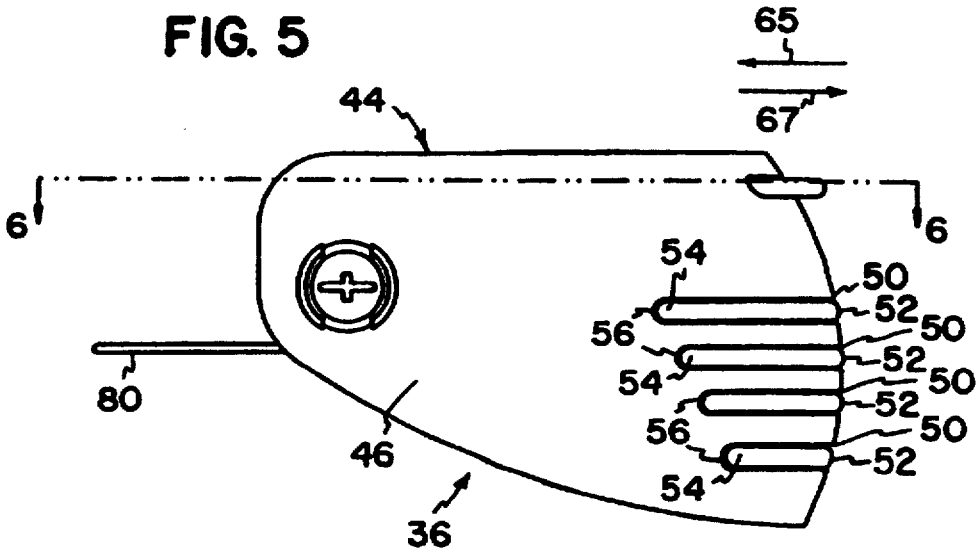
FIG. 5 is a side view of the chalk holding device shown in FIG. 1.

The spring clip 64 also includes a resilient structure for biasing the spring clip 64 toward the retaining position. For example, the spring clip 64 is shown including two lateral projections 72 having posts on which resilient, elastic, or elastomeric structures, such as coil springs 74, are mounted. As shown in FIG. 6, the springs 74 are compressed between the lateral projections 72 and flanges 76 of the chalk holder 38. In such a configuration, the springs 74 are adapted to bias the clip 64 toward the retaining position. Although the spring clip 64 is specifically shown, it will be appreciated that other resilient/biasing structures or configurations can also be used for retaining the chalk 40 within the opening 60.

In use, the spring clip 64 is first moved to the non-retaining position by manually pushing the clip 64 in a forward direction 65 within the transverse slot 68. Once the clip 64 is in the non-retaining position, the chalk 40 is downwardly inserted through the chalk opening and through the clip opening 66. Once a desired length of chalk projects downward from the bottom of the chalk holder 38, the clip 64 is released allowing the springs 74 to move the clip 64 in a rearward direction 67 toward the retaining position. Once the clip 64 is released, the springs 74 bias the retaining portion 70 of the clip 64 against the chalk 40 thereby holding the chalk 40 at the desired location within the chalk opening 60.

As previously mentioned, the chalk holding device 36 also includes spring or biasing structure 42 for biasing the chalk holder 38 toward a ground surface. Although the present invention is not limited to such a configuration, the spring structure 42 is shown as including two coil portions 78 interconnected by an arm structure 80 that loops or extends between the coil portions 78. The coil portions 78 are mounted on hubs 82 that in certain embodiments are snap fitted within co-axially aligned holes defined by the opposing leg portions 46 of the housing 44. The hubs 82 include inner openings 84 adapted to receive the pivot axle 34 that connects the chalk holding device 36 to the skate 20. The coil portions 78 of the spring structure 42 also include free ends 86 that are retained within corresponding channels 88 defined along the leg portions 46 of the housing 44.

The chalk holding device 36 is assembled by first placing the clip springs 74 on the posts of the lateral projections 72 of the spring clip 64. Next, the clip 64 is inserted into the portion of the transverse slot 68 defined by the chalk holder 38 such that the springs 74 are captured between the lateral projections 72 of the clip 64 and the flanges 76 of the chalk holder 38. The leg portions 46 of the housing 44 are then flexed apart and the chalk holder 38 is inserted in the housing 44 such that the ribs 52 fit within the slots 50 formed in the rear portion 48 of the housing 44, and the clip 64 extends through the portion of the transverse slot 68 defined by the housing 44. Once the ribs 52 are inserted within the slots 50, the leg portions 46 are allowed to flex back toward one another such that the chalk holder 38 is secured within the housing 44. Thereafter, the coil portions 78 of the spring structure 42 are placed over the hubs 82, and the hubs are snapped within the co-axially aligned holes defined by the leg portions 46 of the housing 44. Finally, the free ends 86 of the coil portions 78 are inserted in the channels 88 defined by the leg portions 46 of the housing 44, and the axle 34 is inserted through the inner openings 84 defined by the hubs 82.

To mount the chalk holding device 36 on the skate 20, the axle 34 is removed from the chalk holding device 36, and any existing brake axles for securing the brake pad 32 to the frame 26 are preferably also removed. Next, the chalk holding device 36 is maneuvered such that the arm portion 80 of the spring structure 42 loops over the top of the brake arrangement 30, the leg portions 46 straddle the brake pad 32, and the inner openings 84 of the hubs 82 align with corresponding openings defined by the frame 26. The axle 34 is then inserted through the inner openings 84 of the hubs 82 and the corresponding openings defined by the frame. The axle 34 can then be locked in place by means such as a nut or a locking screw. Finally, the chalk 40 is inserted in the chalk opening 60 and adjusted such that a desired length of chalk projects below the chalk holder 38.

With regard to the foregoing description, it is to be understood that changes may be made in detail, especially in matters of the construction materials employed and the shape, size, and arrangement of the parts without departing from the scope of the present invention. For example, FIG. 1 shows a brake arrangement including a transverse pin that extends through the frame. It will be appreciated that the present invention can be used with other known brake arrangements such as a brake arrangement including a pad secured between two extension plates that are pivotally connected to a rear portion of a skate frame. In such a configuration, a chalk holder can be pivotally mounted on a transverse pin used to secure the pad between the extension plates. In certain other embodiments, a chalk holder in accordance with the principles of the present invention can be mounted on a wheel axle or any other type of pin, projection, axle or bolt aligned along an axis that extends across the frame. In additional embodiments, a chalk holder in accordance with the principles of the present invention can include tabs, snaps, or other projections that fit with openings defined by the skate to provide a pivotal connection. Alternatively, the chalk holder can define openings that receive tabs, snaps, or other projections formed on the skate to provide a pivotal connection.

Furthermore, the present invention is not limited to in-line skates, and can be used with conventional roller skates as well as other wheeled devices such as bikes, skate boards, tricycles, remote control vehicles, scooters and other toys. Embodiments suitable for use with such alternative devices can include marking implement holders adapted for retaining, securing or grasping marking elements, and mechanical connecting arrangements including brackets, tabs, pins, snaps or other connecting members for securing the holders to the devices. Preferably, such embodiments also include biasing structures such as springs or elastomeric/resilient members adapted for biasing the holders toward the ground such that the marking elements remain in substantial contact with the ground as the devices are used. However, it will be appreciated that certain embodiments of the present invention, such as embodiments using spray chalk dispensers, may not require actual physical contact with the ground.

It is intended that the specification and depicted embodiment be considered exemplary only, with a true scope and spirit of the invention being indicated by the broad meaning of the following claims.

We claim:

1. An in-line skate comprising:

a boot;

a frame secured to a sole of the boot;

a plurality of tandemly arranged wheels rotatably connected to the frame;

a brake arrangement mounted at a rear portion of the frame; and a chalk holding device pivotally mounted behind the brake arrangement, the chalk holding device including a chalk holder arranged and configured for holding a piece of chalk such that the chalk is adapted to contact a ground surface when the skate is used by a skater.

2. The in-line skate of claim 1, further comprising a spring structure arranged and configured for biasing the chalk holder toward the ground surface.

3. The in-line skate of claim 1, wherein the chalk holder defines a chalk opening sized for receiving the piece of chalk.

4. The in-line skate of claim 3, wherein the chalk opening has a diameter that tapers inward along a length of the chalk opening.

5. The in-line skate of claim 3, further comprising a spring clip for retaining the piece of chalk in the chalk opening.

6. The in-line skate of claim 5, wherein the spring clip is transversely mounted relative to the chalk opening and defines a clip opening sized for receiving the piece of chalk, the spring clip being moveable between a non-retaining position in which the clip opening aligns with the chalk opening such that the chalk opening is not obstructed, and a retaining position in which a portion of the spring clip projects into the chalk opening, the spring clip being biased toward the retaining position by a spring.

7. The in-line skate of claim 3, wherein when the skate is in use, the chalk opening is aligned along a longitudinal axis that forms an acute angle with respect to vertical.

8. The in-line skate of claim 3, wherein the chalk holding device includes a housing including two opposing spaced-apart legs that straddle a brake pad of the brake arrangement, and wherein the chalk holder is mounted within the housing.

9. The in-line skate of claim 8, wherein the housing is generally U-shaped.

10. The in-line skate of claim 8, wherein the legs are pivotally mounted on a pin that is transversely aligned with respect to the frame.

11. The in-line skate of claim 10, wherein the brake pad is also connected to the pin.

12. The in-line skate of claim 10, further comprising a spring structure for biasing the chalk holding device toward the ground surface.

13. The in-line skate of claim 12, wherein the spring structure includes coil portions through which the pin extends, and an arm portion extending between the coil portions.

14. The in-line skate of claim 13, wherein the coil portions are mounted on hubs fit within co-axially aligned openings defined by the legs, the hubs defining inner openings through which the pin extends.

15. A skate comprising:

a frame arrangement;

a plurality of wheels rotatably connected to the frame arrangement; and a holding device connected to the frame arrangement, the holding device including a holder arranged and configured for holding a marking implement such that the marking implement is adapted to mark a ground surface when the skate is used by a skater.

16. The skate of claim 15, further comprising a biasing structure arranged and configured for biasing the holder toward the ground surface.

17. The skate of claim 15, wherein the holder defines a chalk opening and the marking implement comprises a piece of chalk disposed within the chalk opening.

18. The skate of claim 17, wherein the chalk opening has a diameter that tapers inward along a length of the chalk opening.

19. The skate of claim 17, further comprising a spring clip for retaining the piece of chalk in the chalk opening.

20. The skate of claim 19, wherein the spring clip is transversely mounted relative to the chalk opening and defines a clip opening sized for receiving the piece of chalk, the spring clip being moveable between a non-retaining position in which the clip opening aligns with the chalk opening such that the chalk opening is not obstructed, and a retaining position in which a portion of the spring clip projects into the chalk opening, the spring clip being biased toward the retaining position by a spring.

21. The skate of claim 17, wherein when the skate is in use, the chalk opening is aligned along a longitudinal axis that forms an acute angle with respect to vertical.

22. A skate comprising:

a frame arrangement;

a plurality of wheels rotatably connected to the frame arrangement;

a marking implement; and means for connecting the marking implement to the frame arrangement such that the marking implement is adapted to mark a ground surface when the skate is used by a skater.

23. A device for securing a piece of chalk to a skate, the device comprising:

a holder arranged and configured for holding a marking implement; and means for connecting the holder to the skate such that the marking implement is adapted to mark a ground surface when the skate is used by a skater.

24. The device of claim 23, further comprising a biasing structure arranged and configured for biasing the holder toward the ground surface.

25. The device of claim 23, wherein the holder defines a chalk opening having a diameter that tapers inward along a length of the chalk opening, and the marking implement is a tapered piece of chalk.

26. The device of claim 23, further comprising a spring clip for retaining the writing implement in the holder.

27. The device of claim 26, wherein the holder defines a holder opening sized to receive the marking implement, the spring clip being transversely mounted relative to the holder opening and defining a clip opening sized for receiving the writing implement, the spring clip also being moveable between a non-retaining position in which the clip opening aligns with the holder opening, and a retaining position in which a portion of the spring clip projects into the holder opening, and wherein the spring clip is biased toward the retaining position by a spring.

28. The device of claim 23, wherein the means for connecting includes a housing including two opposing spaced-apart legs, and wherein the holder is mounted within the housing.

29. The device of claim 28, wherein the housing is generally U-shaped.

30. The device of claim 28, further comprising a biasing structure for biasing the holding device toward the ground surface, the spring structure including coil portions positioned proximate the legs, and an arm portion extending between the coil portions, the arm portion being adapted to be biased against the skate by the coil portions.

* * * * *